US011761632B2

(12) United States Patent
Gandikota et al.

(10) Patent No.: US 11,761,632 B2
(45) Date of Patent: Sep. 19, 2023

(54) COMBUSTOR SWIRLER WITH VANES INCORPORATING OPEN AREA

(71) Applicant: General Electric Company, Schenectady, NY (US)

(72) Inventors: Gurunath Gandikota, Bangalore (IN); Karthikeyan Sampath, Bangalore (IN); Perumallu Vukanti, Bangalore (IN); Allen M. Danis, Mason, OH (US); Scott M. Bush, West Chester, OH (US); Steven Clayton Vise, Loveland, OH (US); Hari Ravi Chandra, Bangalore (IN); Rimple Rangrej, Bangalore (IN); Saket Singh, Bangalore (IN); Pradeep Naik, Bangalore (IN); Neeraj Kumar Mishra, Bangalore (IN); Arvind Kumar Rao, Bangalore (IN); Balasubramaniam Venkatanarayanan, Bangalore (IN); Ranjeet Kumar Mishra, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/394,848

(22) Filed: Aug. 5, 2021

(65) Prior Publication Data

US 2023/0042970 A1 Feb. 9, 2023

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 3,927,952 A * 12/1975 Kirby ..... F01D 5/046 29/889.23
3,975,141 A * 8/1976 Sweet ..... F23R 3/14 431/352
4,301,657 A * 11/1981 Penny ..... F23R 3/12 60/750

(Continued)

OTHER PUBLICATIONS

Phong et al., Acoustic Transmission Loss of Perforated Plates, 18th AIAA/CEAS Aeroacoustics Conference (33rd AIAA Aeroacoustics Conference) Jun. 4-6, 2012, Colorado Springs, CO.

*Primary Examiner* — William H Rodriguez
(74) *Attorney, Agent, or Firm* — Venable LLP; Edward A. Kmett; Michele V. Frank

(57) ABSTRACT

A dome assembly for a combustor includes: at least one swirler assembly including: at least one swirler including a plurality of swirl vanes arrayed about an axis, the plurality of swirl vanes oriented so as to impart a tangential velocity to air passing through the swirler parallel to the axis; each of the plurality of swirl vanes having a thickness and including a plurality of edges which collectively define a peripheral boundary of the respective swirl vane; wherein at least a selected one of the plurality of swirl vanes includes at least one void passing through the thickness of the selected swirl vane, the void disposed within the peripheral boundary of the selected swirl vane.

14 Claims, 11 Drawing Sheets

(56) References Cited

U.S. PATENT DOCUMENTS 4,587,700 A 5/1986 Curbishley et al.
4,624,104 A * 11/1986 Stroem ..... F01D 5/148 415/115
5,280,703 A * 1/1994 Corrado ..... F02C 3/09 60/804
5,488,825 A * 2/1996 Davis ..... F01D 5/187 415/115
5,675,971 A * 10/1997 Angel ..... F23R 3/286 60/737
5,778,676 A * 7/1998 Joshi ..... F23D 17/002 60/737
6,010,306 A * 1/2000 Bucher ..... F04D 29/34 416/5
6,200,087 B1 * 3/2001 Tung ..... F01D 5/186 415/115
6,309,183 B1 * 10/2001 Bucher ..... F04D 25/088 416/207
6,354,804 B1 * 3/2002 Leung ..... B63H 1/18 416/231 R
6,802,694 B2 * 10/2004 Bucher ..... F04D 29/34 416/207
7,537,431 B1 * 5/2009 Liang ..... F01D 5/187 415/115
8,181,464 B2 * 5/2012 Wilbraham ..... F23C 7/004 60/737
8,316,644 B2 * 11/2012 Wilbraham ..... F23C 7/004 60/737
8,556,584 B2 10/2013 Mallaiah et al.
8,677,757 B2 3/2014 Sadig et al.
8,992,177 B2 3/2015 Wu et al.
9,033,670 B2 5/2015 Mittendorf et al.
9,115,586 B2 8/2015 Jan et al.
9,611,862 B2 4/2017 Brillet et al.
9,726,022 B2 8/2017 Mittendorf et al.
11,384,937 B1 * 7/2022 Sampath ..... F23R 3/26
11,421,882 B2 * 8/2022 Sadasivuni ..... F02C 7/22
11,560,799 B1 * 1/2023 Harris ..... F01D 9/065
2002/0172598 A1 * 11/2002 Bucher ..... F04D 25/088 416/220 A
2005/0053458 A1 * 3/2005 Liang ..... F01D 5/188 415/115
2005/0257530 A1 * 11/2005 Zupanc ..... F23R 3/14 60/776
2008/0078179 A1 * 4/2008 Cai ..... F23R 3/286 60/748
2009/0142716 A1 * 6/2009 Jubb ..... F23R 3/14 60/737
2009/0183511 A1 * 7/2009 Dinu ..... F23R 3/286 60/737
2009/0272117 A1 * 11/2009 Wilbraham ..... F23C 7/004 60/748
2010/0077760 A1 * 4/2010 Laster ..... F23R 3/286 60/742
2010/0223932 A1 * 9/2010 Wilbraham ..... F23R 3/286 60/748
2010/0255435 A1 * 10/2010 Singh ..... F23R 3/286 431/328
2011/0113784 A1 * 5/2011 Headland ..... F23R 3/14 60/737
2011/0138815 A1 * 6/2011 Headland ..... F23R 3/286 60/742
2012/0073302 A1 * 3/2012 Myers ..... F23R 3/343 239/399
2014/0301858 A1 10/2014 Lin et al.
2016/0160653 A1 6/2016 Choi
2016/0341049 A1 * 11/2016 Neale ..... B22C 9/24
2017/0299190 A1 * 10/2017 Patel ..... F02C 7/22
2017/0356295 A1 * 12/2017 Dyson ..... F01D 5/186
2018/0045414 A1 * 2/2018 Sadasivuni ..... F23R 3/286
2019/0257521 A1 * 8/2019 Sadasivuni ..... F02C 7/22
2019/0390554 A1 * 12/2019 Martineau ..... F01D 5/187
2020/0063965 A1 * 2/2020 Uhm ..... F23R 3/286
2020/0072468 A1 * 3/2020 Uhm ..... F23R 3/16
2020/0124286 A1 * 4/2020 Doh ..... F23D 11/26
2020/0393130 A1 * 12/2020 Choi ..... F23R 3/10
2022/0333779 A1 * 10/2022 Vise ..... F23D 14/62
2023/0020796 A1 * 1/2023 Kyllonen ..... F03D 3/062

* cited by examiner

COMBUSTOR SWIRLER WITH VANES INCORPORATING OPEN AREA

BACKGROUND

The present disclosure relates generally to combustors, and more particularly to gas turbine engine combustor swirlers.

A gas turbine engine typically includes, in serial flow communication, a low-pressure compressor or booster, a high-pressure compressor, a combustor, a high-pressure turbine, and a low-pressure turbine. The combustor generates combustion gases that are channeled in succession to the high-pressure turbine where they are expanded to drive the high-pressure turbine, and then to the low-pressure turbine where they are further expanded to drive the low-pressure turbine. The high-pressure turbine is drivingly connected to the high-pressure compressor via a first rotor shaft, and the low-pressure turbine is drivingly connected to the booster via a second rotor shaft.

One type of combustor known in the prior art includes an annular dome assembly interconnecting the upstream ends of annular inner and outer liners. Typically, the dome assembly is provided with swirlers having arrays of vanes. The vanes are effective to produce counter-rotating air flows that generate shear forces which break up and atomize injected fuel prior to ignition.

BRIEF DESCRIPTION

Aspects of the present disclosure describe a combustor swirler having swirl vanes incorporating open space.

According to one aspect of the technology described herein, a dome assembly for a combustor includes: at least one swirler assembly including: at least one swirler including a plurality of swirl vanes arrayed about an axis, the swirl vanes oriented so as to impart a tangential velocity to air passing through the swirler parallel to the axis; each of the swirl vanes having a thickness and including a plurality of edges which collectively define a peripheral boundary of the respective swirl vane; wherein at least a selected one of the plurality of swirl vanes includes at least one void passing through the thickness of the selected swirl vane, the void disposed within the peripheral boundary of the selected swirl vane.

According to another aspect of the technology described herein, a swirler assembly for a combustor includes at least one swirler including a plurality of swirl vanes arrayed about an axis, wherein each of the swirl vanes has a thickness and including a plurality of edges which collectively define a peripheral boundary of the respective swirl vane, and each of the swirl vanes includes at least one perforation passing through the thickness of the swirl vane, the at least one perforation disposed within the peripheral boundary of the swirl vane.

According to another aspect of the technology described herein, a swirler assembly for a combustor includes at least one swirler including a plurality of swirl vanes arrayed about an axis, wherein the plurality of swirl vanes includes an inner ring of sub-vanes and an outer ring of sub-vanes, the inner and outer rings separated by radial gaps.

BRIEF DESCRIPTION OF THE DRAWINGS

The embodiments of the disclosure may be best understood by reference to the following description taken in conjunction with the accompanying drawing figures in which.

DETAILED DESCRIPTION

Figure 1:
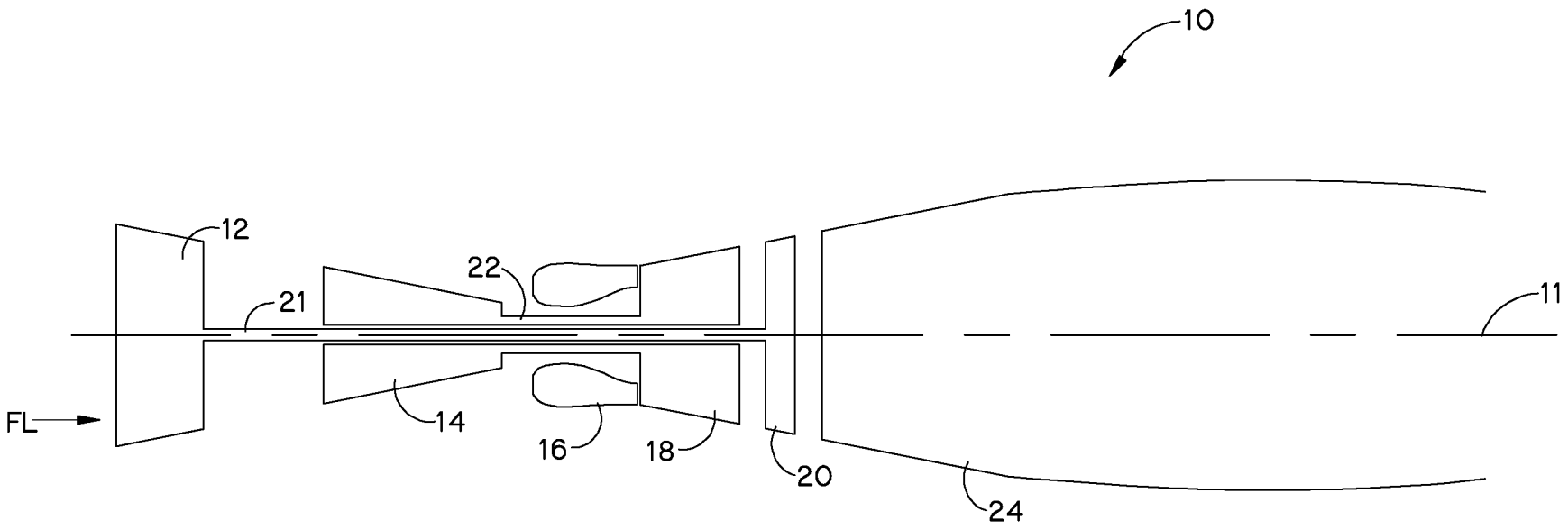
FIG. 1 is a schematic diagram of a gas turbine engine.

Referring to the drawings wherein identical reference numerals denote the same elements throughout the various views, FIG. 1 is a schematic illustration of a gas turbine engine 10 including a low-pressure compressor 12, a high-pressure compressor 14, and a combustor 16. Engine 10 also includes a high-pressure turbine 18 and a low-pressure turbine 20. Low-pressure compressor 12 and low-pressure turbine 20 are coupled by a first shaft 21, and high-pressure compressor 14 and high-pressure turbine 18 are coupled by a second shaft 22. First and second shafts 21, 22 are disposed coaxially about a centerline axis 11 of the engine 10.

It is noted that, as used herein, the terms "axial" and "longitudinal" both refer to a direction parallel to the centerline axis 11, while "radial" refers to a direction perpendicular to the axial direction, and "tangential" or "circumferential" refers to a direction mutually perpendicular to the axial and radial directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "FL" in FIG. 1. These directional terms are used merely for convenience in description and do not require a particular orientation of the structures described thereby.

In operation, air flows through low-pressure compressor 12 and compressed air is supplied from low-pressure compressor 12 to high-pressure compressor 14. The highly compressed air is delivered to combustor 16. Airflow from combustor 16 drives turbines 18 and 20 and exits gas turbine engine 10 through a nozzle 24.

One typical type of combustor is an annular combustor including combustion chamber defined between annular inner and outer liners. The forward or upstream end of the combustor chamber is spanned by a structure referred to as a "dome", or "dome assembly", or "domed end". Numerous basic configurations of domes are known and used in the prior art. A common feature of the different configurations is one or more swirlers having arrays of swirl vanes which impart a rotation or swirl (e.g. tangential velocity component relative to an axis) to an air flow entering the combustor. According to the general principles of the present disclosure, at least some of the swirl vanes may incorporate open spaces for the purpose of mitigating combustion dynamics. Reduction of combustion instabilities can improve performance, stability and durability. The concepts described herein are generally applicable to swirlers found in any type of combustor dome structure.

Figure 2:
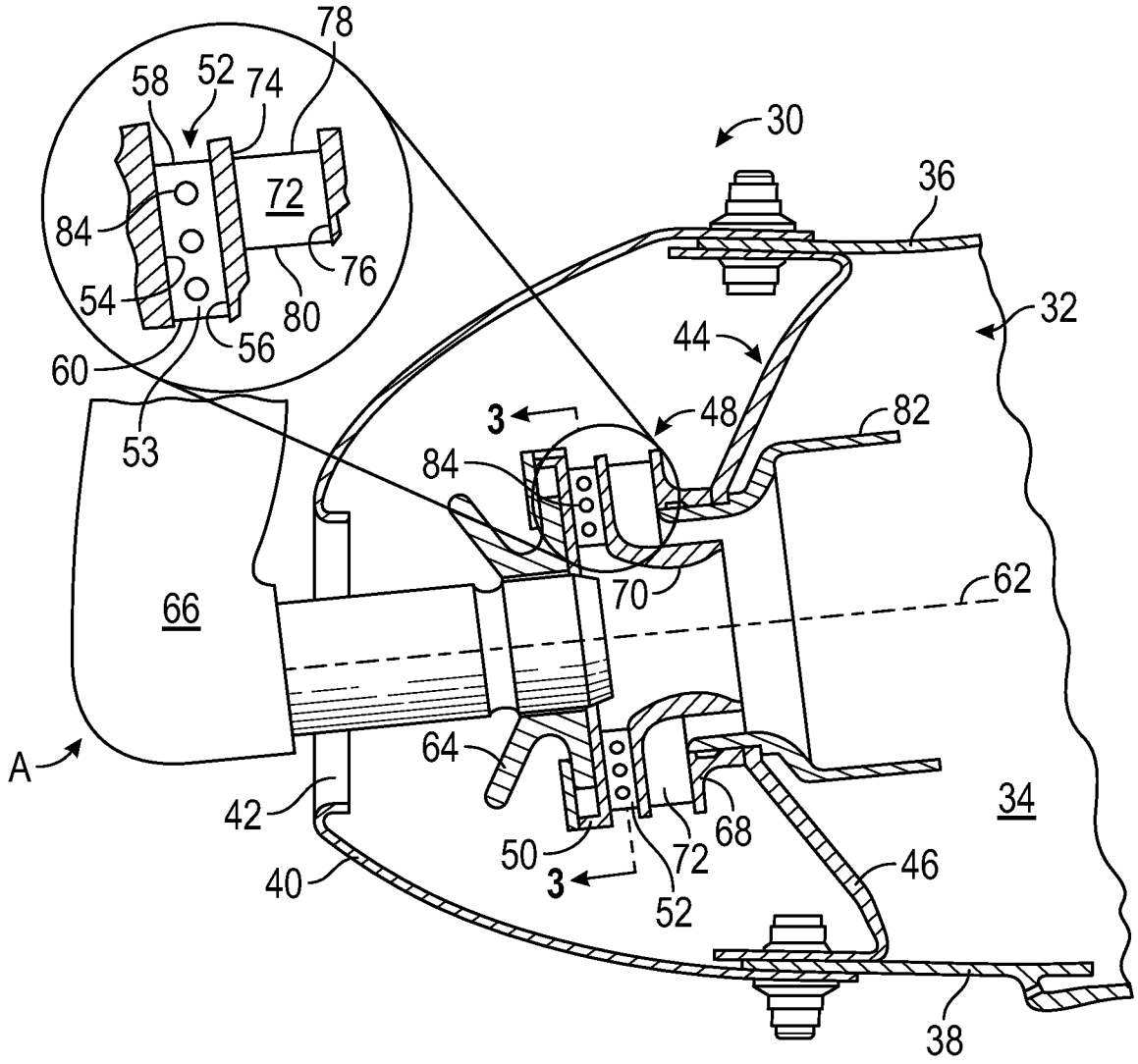
FIG. 2 is a schematic, half-sectional view of a portion of a combustor suitable for use in the gas turbine engine shown in FIG. 1.

FIG. 2 shows the forward end of a combustor 30 having an overall configuration generally referred to as "rich burn", suitable for incorporation into an engine such as engine 10 described above. The combustor 30 includes a hollow body 32 defining a combustion chamber 34 therein. The hollow body 32 is generally annular in form and is defined by an outer liner 36 and an inner liner 38. The upstream end of the hollow body 32 is substantially closed off by a cowl 40 attached to the outer liner 36 and to the inner liner 38. At least one opening 42 is formed in the cowl 40 for the introduction of fuel and compressed air. The compressed air is introduced into the combustor 30 from high-pressure compressor 14 in a direction generally indicated by arrow A. The compressed air passes primarily through the opening 42 to support combustion and partially into the region surrounding the hollow body 32 where it is used to cool both the liners 36, 38 and turbomachinery further downstream.

Figure 3:
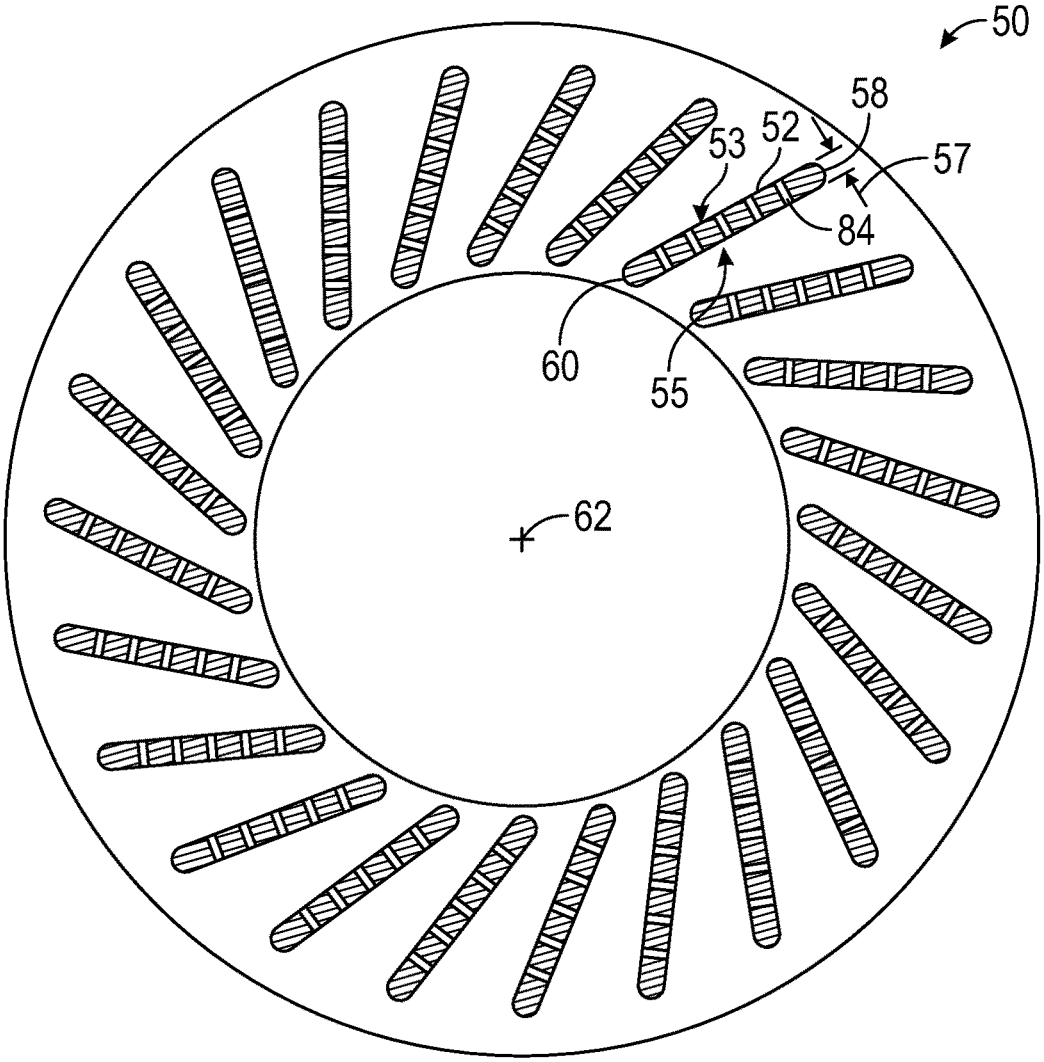
FIG. 3 is a view taken along lines 3-3 of FIG. 2.
Figure 4:
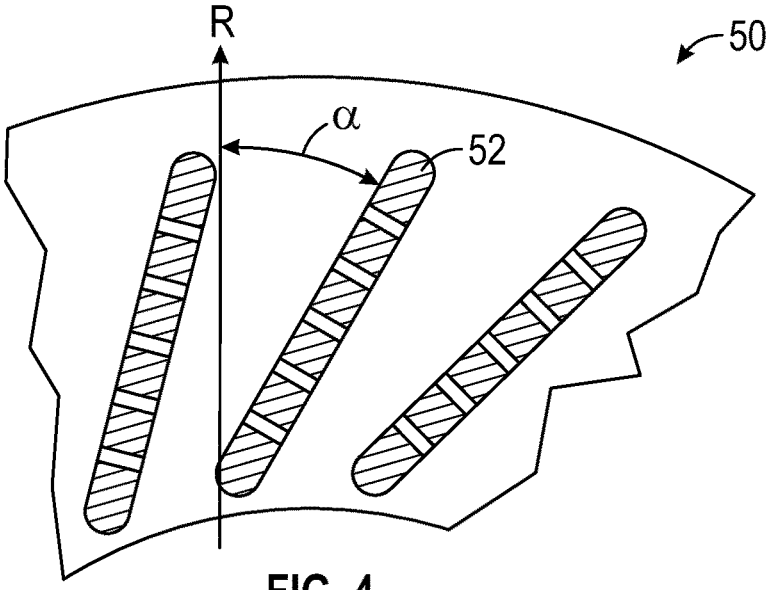
FIG. 4 is an enlarged view of a portion of FIG. 3.

Located between and interconnecting the outer and inner liners 36, 38 near their upstream ends is a dome assembly 44. The dome assembly 44 includes an annular spectacle plate 46 and a plurality of circumferentially spaced swirler assemblies 48 (only one shown in FIG. 2) mounted in the spectacle plate 46. The spectacle plate 28 is attached to the outer and inner liners 36, 38. Each swirler assembly 48 includes a primary swirler 50 that comprises a plurality e.g., an annular array, of angularly directed primary swirl vanes 52. Each primary swirl vane 52 is bounded by a forward edge 54, an aft edge 56, a leading edge 58, and a trailing edge 60. Collectively, these four edges define a peripheral boundary of the respective primary swirl vane 52. Referring to FIG. 3, each of the primary swirl vanes 52 includes an outboard surface 53 defined by the peripheral boundary, and an inboard surface 55 defined by the peripheral boundary, and the swirl vane 52 has a thickness 57 defined between the outboard surface 53 and the inboard surface 55. As further shown in FIG. 3, the thickness 57 of each swirl vane 52 is generally constant (e.g., parallel) between the outboard surface 53 and the inboard surface 55 and extending from the leading edge 58 to the trailing edge 60. The leading and trailing edges 58, 60 are defined with respect to the direction of airflow. Accordingly, the leading edge 58 is radially outboard of the trailing edge 60 relative to a centerline axis 62 of the swirler assembly 48. As seen in FIGS. 3 and 4, the primary swirl vanes 52 are angled with respect to the centerline axis 62 (FIG. 2) so as to impart a swirling motion (i.e., tangential velocity component) to the air flow passing therethrough More specifically, the primary swirl vanes 52 are disposed at a "vane angle" $\alpha$ measured relative to a radial direction R, where a zero degree angle $\alpha$ represents a pure radial direction, and a 90° angle $\alpha$ represents a pure tangential direction. Referring again to FIG. 2, a ferrule 64 is loosely mounted on the forward end of the primary swirler 50 and coaxially receives a fuel nozzle 66.

The swirler assembly 48 further includes a secondary swirler 68 that adjoins the primary swirler 50, downstream thereof, and is fixed with respect to the spectacle plate 46. The secondary swirler 68 includes a venturi 70 including a throat of minimum flow area and a plurality e.g., an annular array, of secondary swirl vanes 72 disposed coaxially about the venturi 70. Each secondary swirl vane 72 is bounded by a forward edge 74, an aft edge 76, a leading edge 78, and a trailing edge 80. Collectively, these four edges define a peripheral boundary of the respective secondary swirl vane 72. The leading and trailing edges 78, 80 are defined with respect to the direction of airflow. Accordingly, the leading edge 78 is radially outboard of the trailing edge 80 relative to the centerline axis 62. The secondary swirl vanes 72 are angled with respect to the centerline axis 62 so as to impart a swirling motion to the air flow passing therethrough, similar to the primary swirl vanes 52. They may be oriented at a vane angle opposite to vane angle $\alpha$ described above to produce a counter-rotating swirl.

The venturi 70 and the ferrule 64 of the primary swirler 50 are both coaxially aligned with the centerline axis 62 of the swirler assembly 48.

In operation, air from the opening 42 passes through the primary swirl vanes 52. The swirling air exiting the primary swirl vanes 52 interacts with fuel injected from the fuel nozzle 66 so as to mix as it passes into the venturi 70. The secondary swirl vanes 72 then act to present a swirl of air swirling in the opposite direction that interacts with the fuel/air mixture so as to further atomize the mixture and prepare it for combustion in the combustion chamber 34. Each swirler assembly 48 has a deflector 82 extending downstream therefrom for preventing excessive dispersion of the fuel/air mixture and shielding the spectacle plate 46 from the hot combustion gases in the combustion chamber 34.

FIGS. 2 and 3 illustrate an embodiment in which at least some of the swirl vanes 52, 72 incorporate open spaces or voids. In this specific embodiment, the open spaces or voids are in the form of perforations. As used herein, the term "perforations" refer to open spaces or voids which pass completely through the thickness 57 of the swirl vanes 52, 72, and which encompass less than the full width of the swirl vanes 52, 72 measured between the respective forward edge 54 and the aft edge 56.

In the example of FIGS. 2 and 3, each of the primary swirl vanes 52 includes a plurality of perforations 84 passing therethrough. These are shown as circular holes in the specific example. The number, size, spacing, and orientation of the perforations 84 may be selected as required to optimize their performance for particular application. Perforations (not shown) could also be incorporated into the secondary swirl vanes 72.

Figures 5, 6, 7, 8, 9, 10, 11, 12:
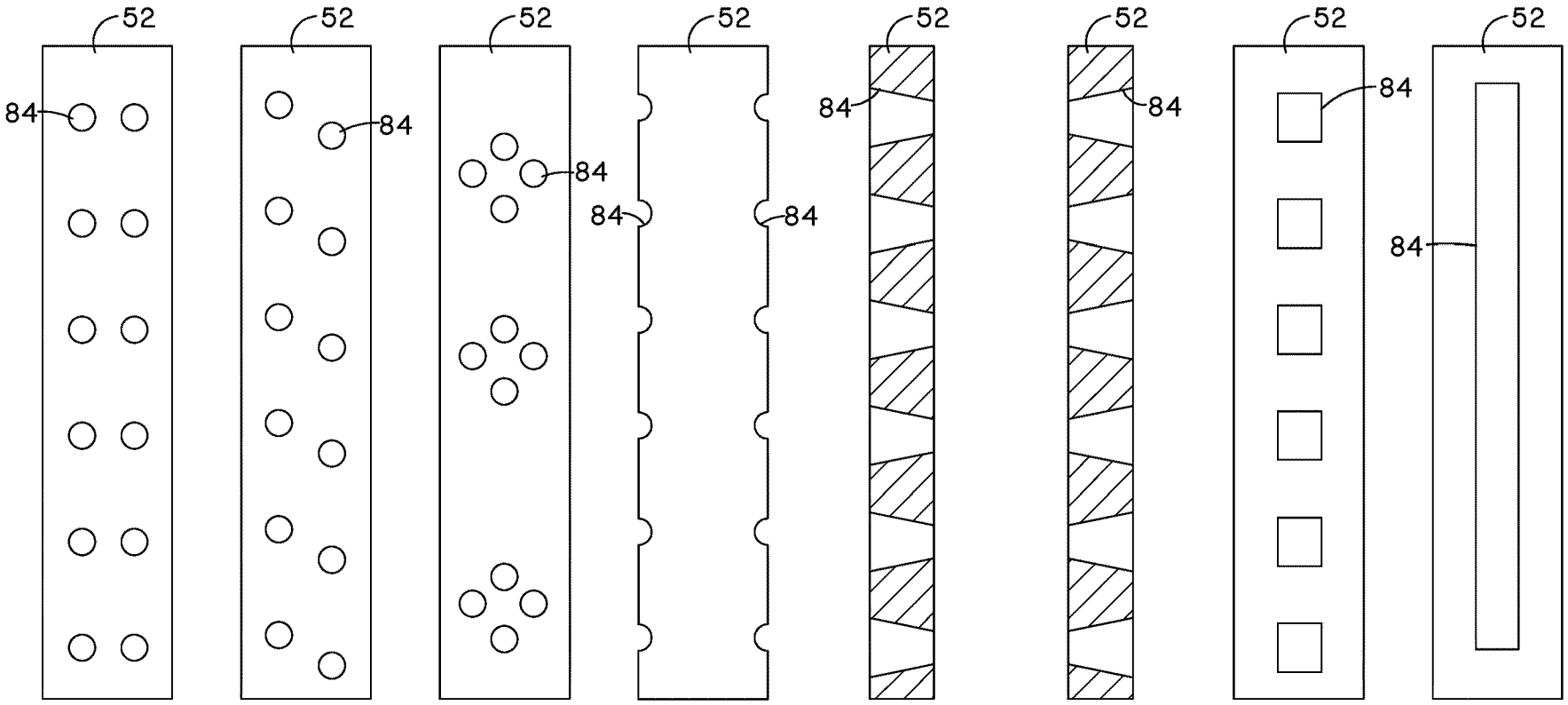
FIG. 5 is a schematic plan view illustration of vane perforations disposed in multiple rows.
FIG. 6 is a schematic plan view illustration of vane perforations disposed in staggered rows.
FIG. 7 is a schematic plan view illustration of vane perforations disposed in clusters.
FIG. 8 is a schematic plan view illustration of vane perforations disposed close to vane edges.
FIG. 9 is a schematic plan view illustration of vane perforations configured as converging openings.
FIG. 10 is a schematic plan view illustration of vane perforations configured as diverging openings.
FIG. 11 is a schematic plan view illustration of discrete polygonal-shaped vane perforations.
FIG. 12 is a schematically in the illustration of a perforation configured as an elongated slot.

The term "perforations" can refer to numerous shapes such as circles, ellipses, polygons, or slots. Some examples are shown in FIGS. 5-12. FIG. 5 shows perforations 84 disposed in multiple rows. FIG. 6 shows perforations 84 disposed in staggered rows. FIG. 7 shows perforations 84 disposed in clusters. FIG. 8 shows perforations 84 disposed overlapping the vane forward and aft edges. FIG. 9 shows perforations 84 configured as converging with respect to the direction of flow (i.e. nozzles). FIG. 10 shows perforations 84 configured as diverging with respect to the direction of flow (i.e., diffusers). FIG. 11 shows a plurality of discrete polygonal-shaped perforations 84. FIG. 12 shows a perforation 84 configured as an elongated slot.

During combustor operation, the perforations 84 perform two functions: (1) communicate pressure from one side of the vane to the other side. (2) provide a flow tangential velocity component. The basic result of the perforations is damping which reduces harmonics in the flow.

As a general principle. It is believed that the perforations 84 should be selected to achieve a specific porosity, where "porosity" refers to a ratio of the total open area of the specific primary swirl vane 52 to the total surface area of the primary swirl vane 52 within its peripheral boundary.

As a general statement, a greater porosity provides a greater effect in mitigating combustion dynamics. Analysis has shown that as porosity decreases to very low levels, the effectiveness of the perforations in mitigating combustion dynamics is reduced. Conversely, when porosity is increased beyond a certain threshold, the effectiveness of the perforations in mitigating combustion dynamics reaches a plateau, while further perforation area increase beyond that threshold is likely to reduce the swirling effectiveness of the primary swirl vanes 52.

In one example, the porosity may be between 5% and 15%.

In another example, the porosity may be approximately 10%.

It should be appreciated, that as used herein, terms of approximation, such as "about" or "approximately," are intended to encompass unintentional sources of minor variation in the associated numerical value such as manufacturing tolerances, as well as intentional changes in the associated numerical value which do not materially affect the resulting function. If not otherwise stated, the terms "about" or "approximately" when used to modify a numerical value are intended to encompass the stated value in addition to values plus or minus 10% of the stated numerical value.

Figure 13:
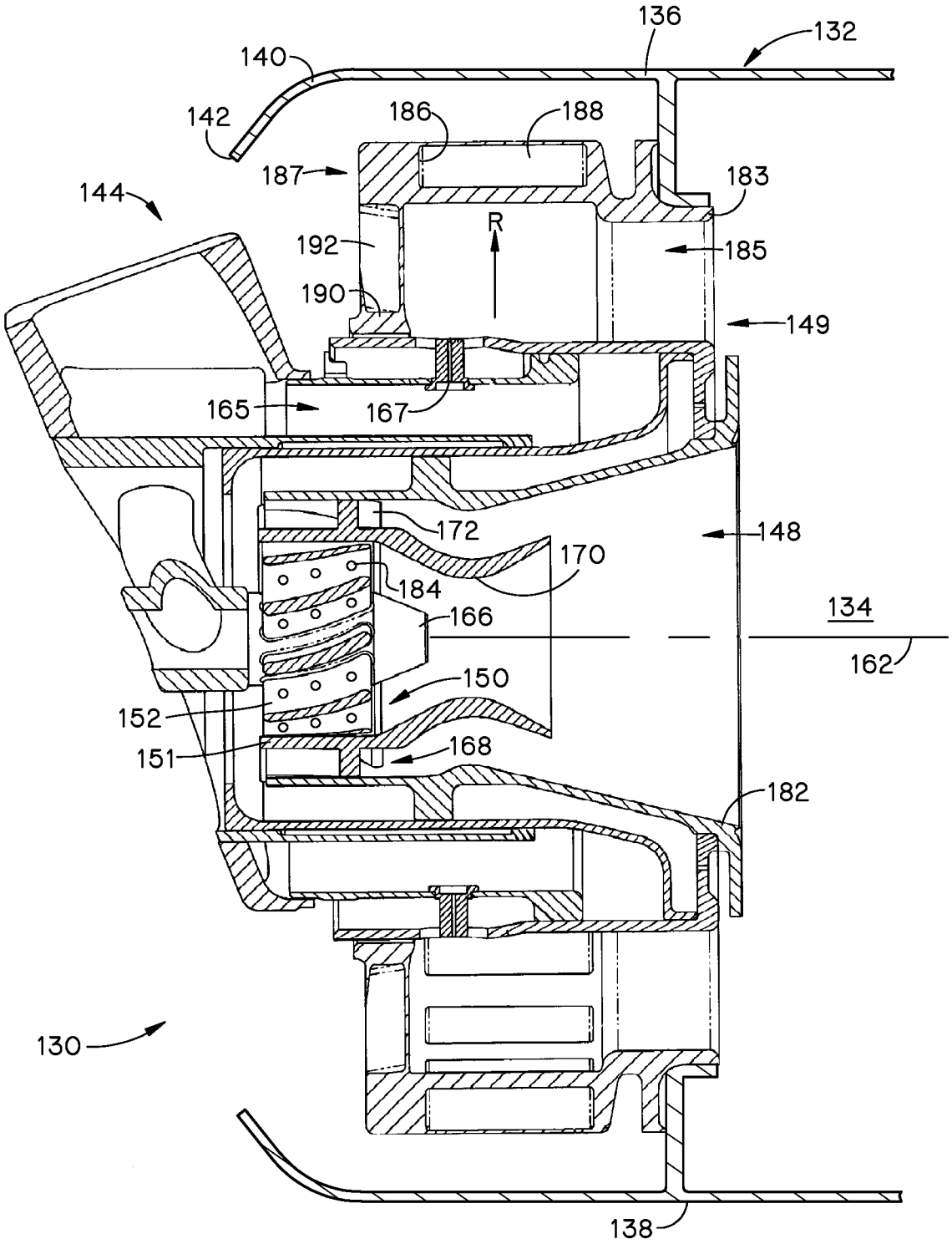
FIG. 13 is a schematic, half-sectional view of a portion of an alternative combustor suitable for use in the gas turbine engine shown in FIG. 1.
Figure 14:
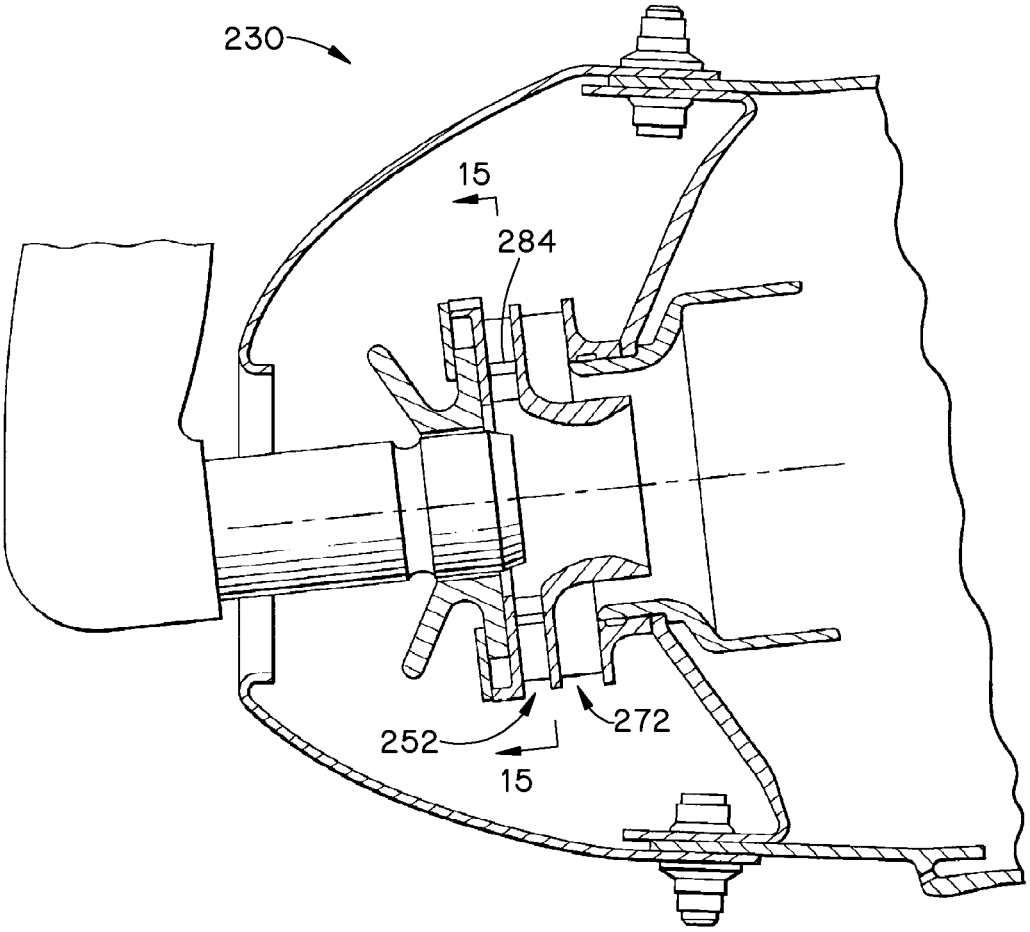
FIG. 14 is a schematic, half-sectional view of a portion of an alternative combustor suitable for use in the gas turbine engine shown in FIG. 1.

FIGS. 13 and 14 illustrate an example of how perforations of the type described above can be incorporated into another configuration of combustor dome assembly.

FIG. 13 shows the forward end of a combustor 130 having an overall configuration generally referred to as twin annular premixed swirler or "TAPS", suitable for incorporation into an engine such as engine 10 described above. The combustor 30 includes a hollow body 132 defining a combustion chamber 134 therein. The hollow body 132 is generally annular in form and is defined by an outer liner 136 and an inner liner 138. The upstream end of the hollow body 132 is substantially closed off by a cowl 140 attached to the outer liner 136 and to the inner liner 138. At least one opening 142 is formed in the cowl 140 for the introduction of fuel and compressed air.

Located between and interconnecting the outer and inner liners 136, 138 near their upstream ends is a mixing assembly or dome assembly 144. The dome assembly 144 includes a pilot mixer 148, a main mixer 149, and a fuel manifold 165 positioned therebetween. More specifically, it will be seen that pilot mixer 148 includes an annular pilot housing 182 having a hollow interior, a pilot fuel nozzle 166 mounted in pilot housing 182 and adapted for dispensing droplets of fuel to the hollow interior of pilot housing 182. Further, pilot mixer 148 includes an inner swirler 150 located at a radially inner position adjacent pilot fuel nozzle 166, an outer swirler 168 located at a radially outer position from inner swirler 150, and a splitter 151 positioned therebetween. Splitter 151 extends downstream of pilot fuel nozzle 166 to form a venturi 170 at a downstream portion.

The inner and outer swirlers 150 and 168 are generally oriented parallel to a centerline axis 162 through the dome assembly 144 and include a plurality of vanes for swirling air traveling therethrough. More specifically, the inner swirler 150 includes an annular array of inner swirl vanes 152 disposed coaxially about centerline axis 162. Each inner swirl vane 152 is bounded by four edges (not separately labeled) including a leading edge, a trailing edge, an inboard edge, and an outboard edge. Collectively, the four edges define a peripheral boundary of the respective inner swirl vane 152. The inner swirl vanes 152 are angled with respect to the centerline axis 162 so as to impart a swirling motion (i.e., tangential velocity component) to the air flow passing therethrough The outer swirler 168 includes an annular array of outer swirl vanes 172 disposed coaxially about centerline axis 162. Each outer swirl vane 172 is bounded by four edges (not separately labeled) including a leading edge, a trailing edge, an inboard edge, and an outboard edge. Collectively, the four edges define a peripheral boundary of the respective outer swirl vane 172. The inner swirl vanes 152 are angled with respect to the centerline axis 162 so as to impart a swirling motion (i.e., tangential velocity component) to the air flow passing therethrough The main mixer 149 further includes an annular main housing 183 radially surrounding pilot housing 182 and defining an annular cavity 185, a plurality of fuel injection ports 167 which introduce fuel into annular cavity 185, and a main swirler arrangement identified generally by numeral 187.

Swirler arrangement 187 includes a first main swirler 186 positioned upstream from fuel injection ports 167. As shown, the flow direction of the first main swirler 186 is oriented substantially radially to centerline axis 162. The first main swirler 186 includes a plurality of swirl vanes 188. The first main swirl vanes 188 are angled with respect to the centerline axis 162 so as to impart a swirling motion (i.e., tangential velocity component) to the air flow passing therethrough. More specifically, the first main swirl vanes 188 are disposed at an acute vane angle measured relative to a radial direction R.

Swirler arrangement 187 includes a second main swirler 190 positioned upstream from fuel injection ports 167. The flow direction of the second main swirler 190 is oriented substantially axially to centerline axis 162. Second main swirler 190 includes a plurality of vanes 192. The second main swirl vanes 192 are angled with respect to the centerline axis 162 so as to impart a swirling motion (i.e., tangential velocity component) to the air flow passing therethrough. More specifically, the second main swirl vanes 192 are disposed at an acute vane angle measured relative to an axial direction.

In the example of FIG. 13, each of the inner swirl vanes 152 of the swirler 150 includes a plurality of perforations 184 passing therethrough. These are shown as circular holes in the specific example. The number, size, spacing, and orientation of the perforations 184 may be selected as required to optimize their performance for particular application. Perforations (not shown) could also be incorporated into the outer swirl vanes 172. The porosity parameters may be as described above.

Optionally, perforations (not shown) could also be incorporated into the vanes of the first main swirler 186 or the second main swirler 190.

Figure 15:
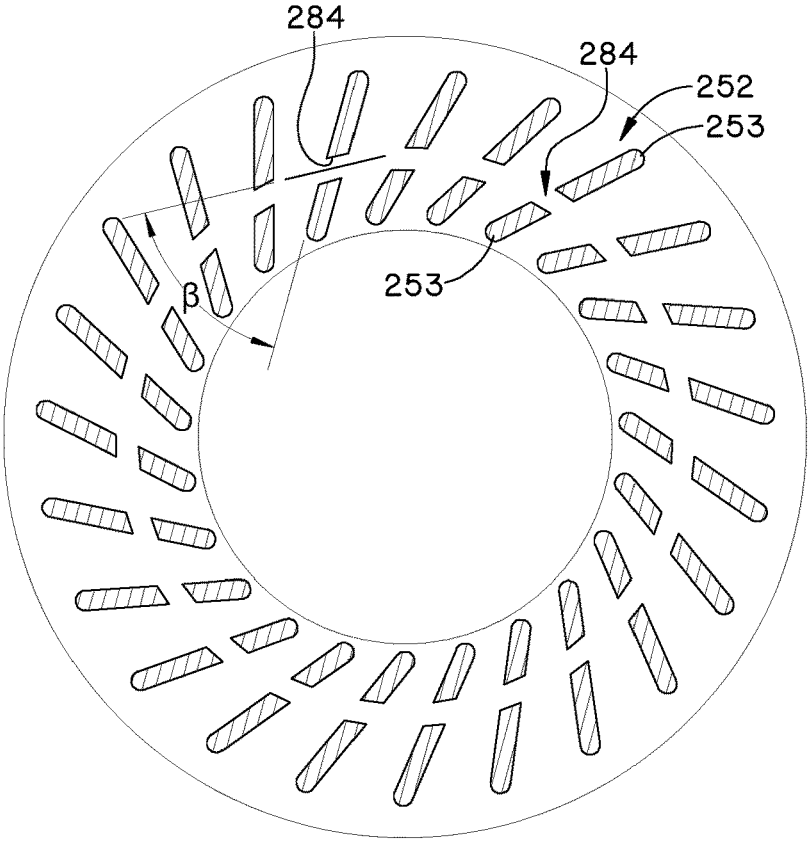
FIG. 15 is a view taken along lines 15-15 of FIG. 14.

As an alternative to the perforations described above, open area or voids can be incorporated into swirl vanes in the form of gaps or separations. FIGS. 14 and 15 illustrate an embodiment of a "rich burn" type combustor 230 similar in overall construction to combustor 30 shown in FIGS. 2 and 3 and including primary and secondary swirl vanes 252, 272 respectively.

FIGS. 14 and 15 illustrate an embodiment in which at least some of the swirl vanes 252, 272 incorporate open spaces in the form of gaps. As used herein, the term "gaps" refer to openings which encompass the full width of the swirl vanes, effectively dividing or split each of the swirl vanes 252, 272 into two or more separate, smaller vanes. The gaps can have numerous shapes.

In the example of FIGS. 14 and 15, each of the primary swirl vanes 252 includes a plurality of gaps 284 passing therethrough, effectively dividing each primary swirl vane 252 into sub-vanes 253. The number, size, shape, spacing, and orientation of the gaps 284 may be selected as required to optimize their performance for particular application. Gaps (not shown) could also be incorporated into the secondary swirl vanes 272.

During combustor operation, the gaps perform two functions, similar to the perforations. (1) communicate pressure from one side of the vane to the other side. (2) provide a flow tangential velocity component. The basic result of the perforations is damping which reduces harmonics in the flow. Communication of pressure is more significant slightly above or below the vane throat. It is less significant in areas away from the throat. So, for example at the inlet/leading edge.

As a general principle. It is believed that the gaps 284 should be selected to achieve a specific porosity, as defined above with respect to the perforations.

As noted above, greater porosity provides a greater effect in mitigating combustion dynamics. However, when porosity is increased beyond a certain threshold, the effectiveness of the perforations in mitigating combustion dynamics reaches a plateau, while further perforation area increase beyond that threshold is likely to reduce the swirling effectiveness of the primary swirl vanes.

In one example, the porosity may be between 5% and 15%.

In another example, the porosity is approximately 10%.

As seen in FIG. 15, the gaps 284 extend in a direction defined by an angle β with respect to the surface of the primary swirl vane 252, where β would have a value of 90 degrees if normal to the surface of the swirl vane. In one example, the angle β may lie in the range of approximately 70° to approximately 130°.

Figure 16:
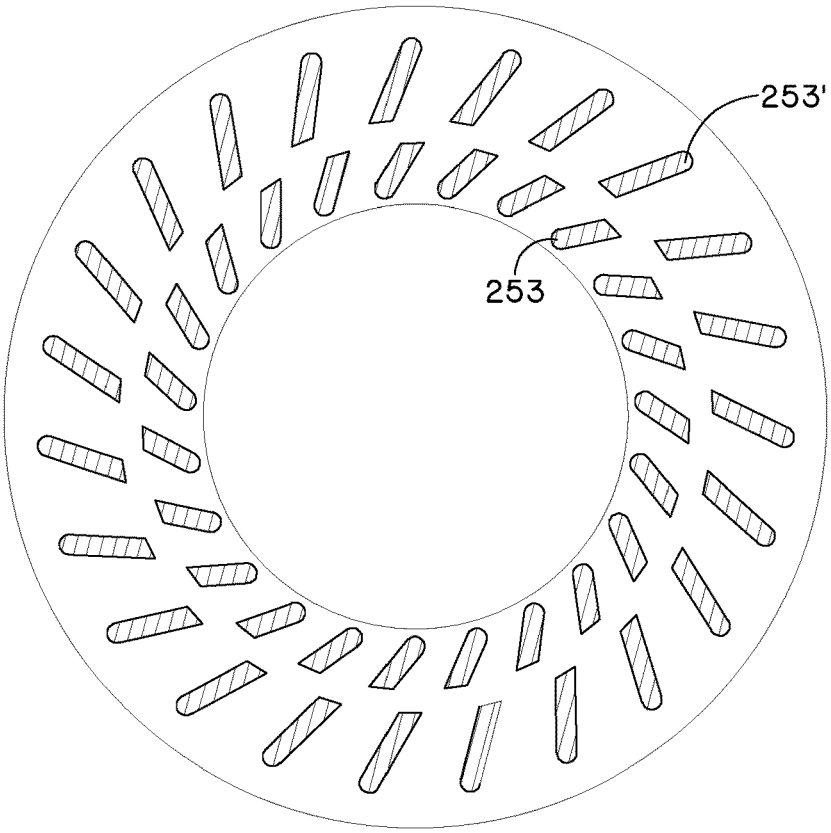
FIG. 16 is a view of an alternative arrangement of the vanes shown in FIG. 15.

In the example shown in FIGS. 14 and 15, each pair of sub-vanes 253 is generally aligned in the radial direction. Stated another way, each pair of sub-vanes 253 defines a single primary swirl vane 252 with a gap 284 passing therethrough. Alternatively, as shown in FIG. 16, the sub-vanes 253 may have different angular orientations such that a ring of inner sub-vanes 253 is angularly offset from a ring of outer sub-vanes 253'. Another potential option is to have concentric rings of sub-vanes with differing number of vanes in each ring.

Figure 17:
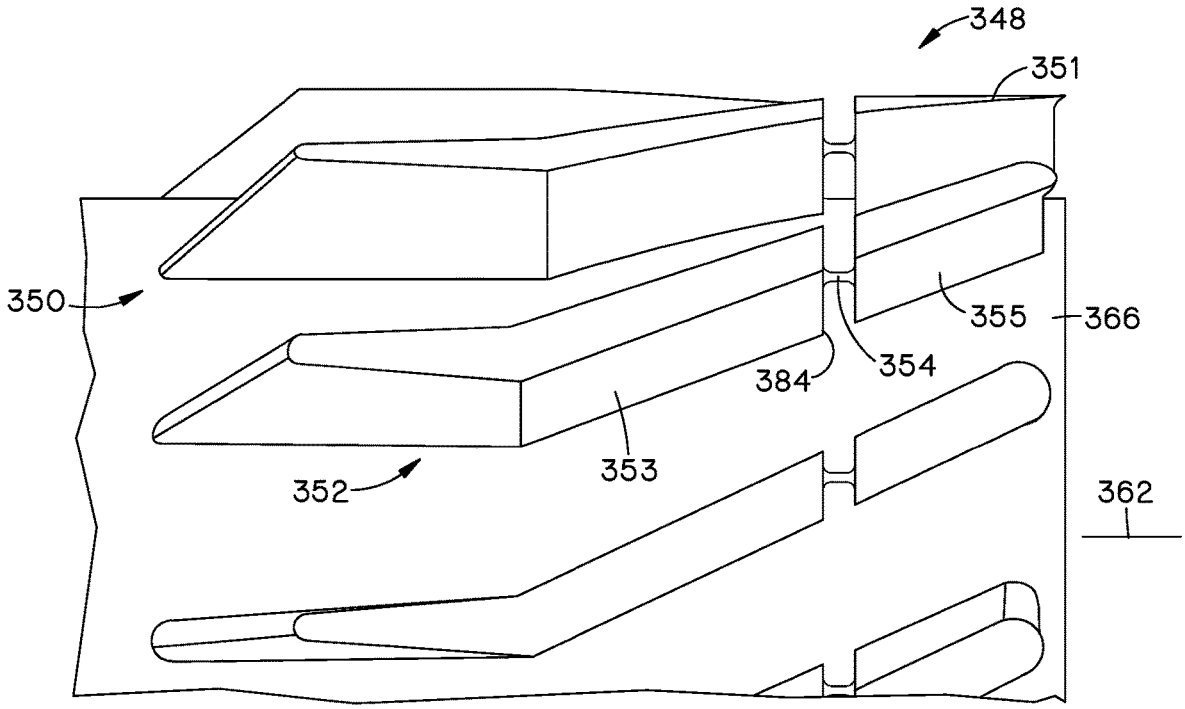
FIG. 17 is a side view of an alternative pilot mixer.

FIG. 17 illustrates an example of how gaps or separations of the type described above can be incorporated into a TAPS-type combustor dome assembly.

FIG. 17 illustrates a portion of a pilot mixer 348 similar to pilot mixer 148 described above. It includes a central pilot fuel nozzle 366 surrounded by an inner swirler 350. It will be understood that inner swirler 350 is surrounded by a splitter 351 which is mostly cutaway in the current view such that only a small portion is visible.

The inner swirler 350 is generally oriented parallel to a centerline axis 362 and includes an annular array of inner swirl vanes 352 disposed coaxially about centerline axis 362. Each inner swirl vane is bounded by four edges (not separately labeled) including a leading edge, a trailing edge, an inboard edge, and an outboard edge. Collectively, the four edges define a peripheral boundary of the respective inner swirl vane 352. The inner swirl vanes 352 are angled with respect to the centerline axis 362 so as to impart a swirling motion (i.e., tangential velocity component) to the air flow passing therethrough.

In the example of FIG. 17, each of the pilot inner swirl vanes 352 includes a gap 384 passing therethrough, effectively dividing pilot inner swirl vane 352 into forward and aft sub-vanes 353, 355 respectively. The number, size, shape, spacing, and orientation of the gaps 384 may be selected as required to optimize their performance for particular application. Gaps (not shown) could also be incorporated into the pilot outer swirl vanes (not shown) of the pilot mixer 348.

Numerous variations are possible on the specific configuration of the pilot inner swirl vanes 352, such as size, number, and shape. In one variation, the row of aft sub-vanes 355 may have a different number of sub-vanes 355 than the row forward sub-vanes 353, and/or may be angularly offset. In another variation, the row of aft sub-vanes 355 may be oriented at a different angle relative to the centerline axis 362 than the full row of forward sub-vanes 353.

Optionally, the forward and aft sub-vanes 353, 355 may be interconnected by small ligaments 354. These may serve to provide mutual support, for example during an additive manufacturing procedure or other manufacturing procedure. It may be left in place subsequent to manufacture or removed.

Figure 18:
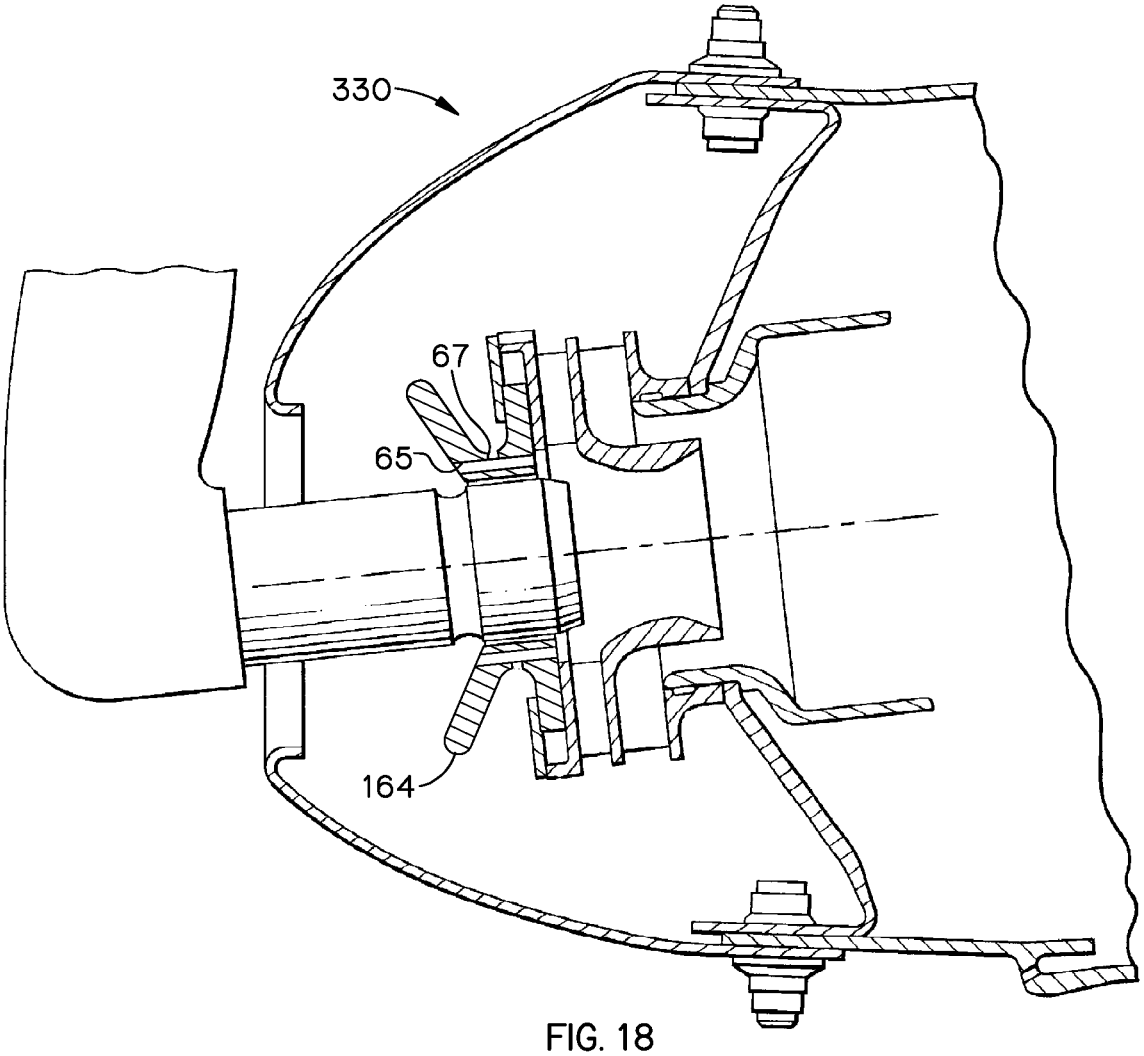
FIG. 18 is a schematic, half-sectional view of a combustor incorporating a ferrule with purge holes.

FIG. 18 illustrates an embodiment of a "rich burn" type combustor 330 similar in overall construction to combustor 30 shown in FIGS. 2 and 3. The ferrule 164 includes axial purge holes 65 of a known type. The ferrule has a strong influence on swirler dynamics. In this example, a circumferential split or groove 67 is formed around the periphery of the ferrule 164. This split 67 will allow flow and pressure communication across and between the otherwise separate purge holes 65. This feature is anticipated to mitigate combustion dynamics. It may be incorporated in addition to or as an alternative to the perforations described above.

The perforations or voids described above, in addition to their combustion dynamics mitigation function, may be used to improve fuel/air mixing within the combustor. This function may be facilitated by combining the voids with recesses.

FIGS. 19-24 illustrate swirler structures in which at least some of the swirl vanes incorporate perforations or voids which communicate with a vane recess. As used herein, the term "vane recess" refers to an opening which communicates with an outer surface of the vane and which extends partially through the thickness of the vane.

Figure 19:
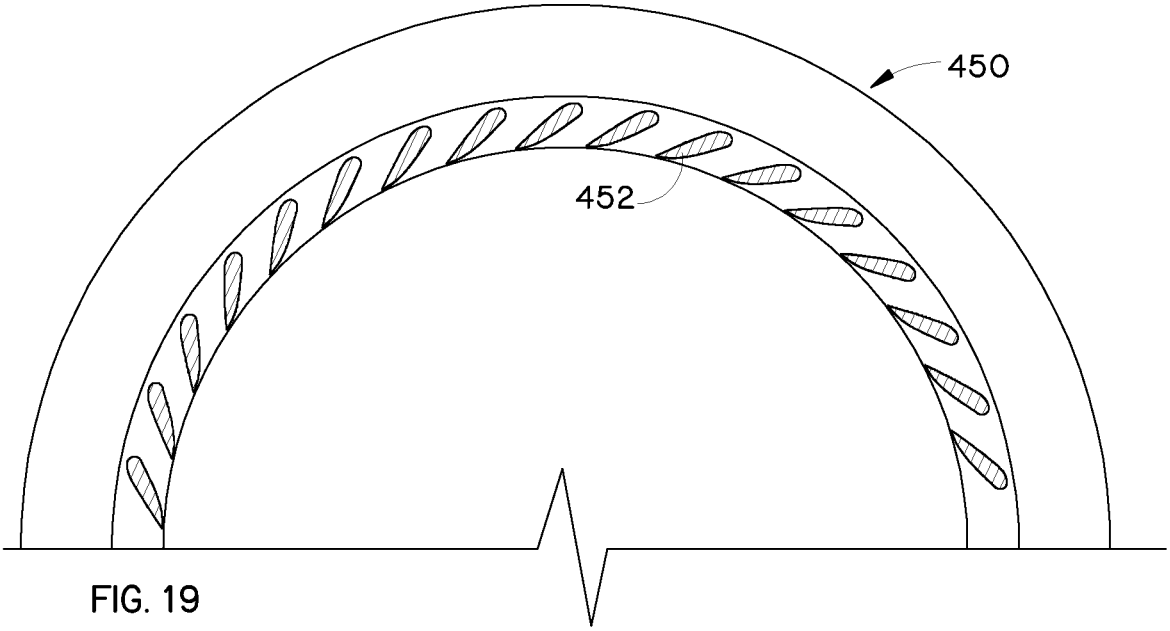
FIG. 19 is a schematic, half-sectional view of a mixer for a combustor.
Figure 20:
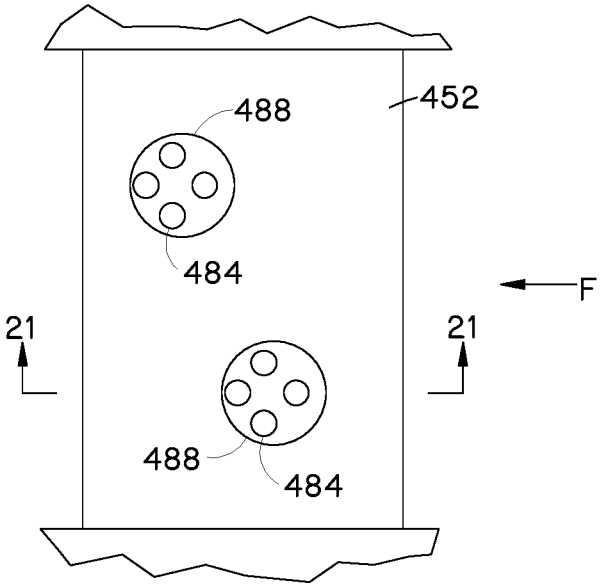
FIG. 20 is a top plan view of one of the swirl vanes of the mixer of FIG. 19.
Figure 21:
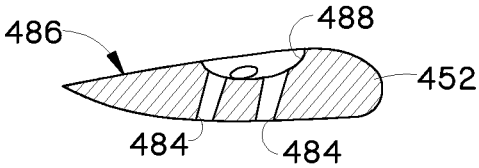
FIG. 21 is a sectional view taken along lines 21-21 of FIG. 20.
Figure 22:
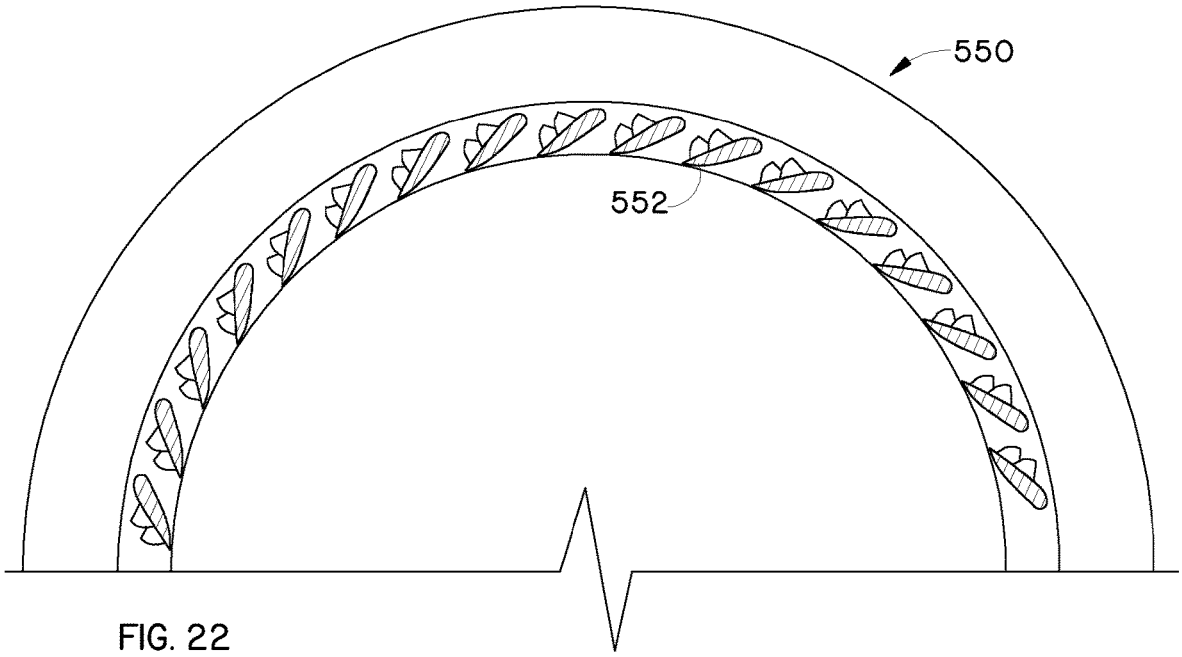
FIG. 22 is a schematic, half-sectional view of a mixer for a combustor.
Figure 23:
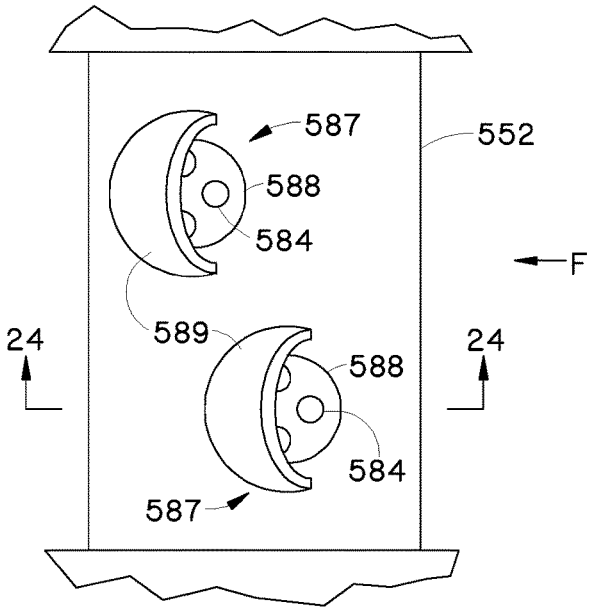
FIG. 23 is a top plan view of one of the swirl vanes of the mixer of FIG. 22.

In the example of FIGS. 19-21, a swirler 450 has an annular array of swirl vanes 452, similar to the swirler 50 described above. Each swirl vane 452 includes at least one perforation or void passing through its thickness. In the illustrated example, the perforations or voids are arranged as groups of holes 484. The holes 484 may be arranged in a line, arc, or staggered pattern, and can be parallel to, or extend at different angles, relative to the outer surface 486 of the swirl vane 452. In one example, the holes 484 can be oriented in a range from −60 degrees to 60 degrees with respect to the normal direction to the vane outer surface 486, to produce higher mass flow rate through the holes 484, creating higher turbulence.

The size (e.g. diameter) of the holes 484 can be kept same or varied from forward to aft end of the swirl vane 452 to increase turbulence as required in a staged manner. With varying sizes of holes 484 and/or converging holes, there will be a staged increase in turbulence as the flow approaches the fuel injector (FIG. 2) which will improve fuel breakup and fuel-air mixing and reduce NOx as compared to constant size holes.

The holes 484 will create circumferential uniformity in total kinetic energy levels due to circumferential and radial distribution of the holes 484.

The inlets of the holes 484 can be at a higher radius relative to the swirler centerline (nearly close to entrance of the swirl vanes 452) and their exit can be at a radius from the middle of the swirl vane 452 to the exit of the swirl vane 452. This feature helps to capture higher pressure differential across the swirl vane 452 and thereby higher mass flows through the holes 484.

The holes 484 of each group communicate with a recess in the swirl vane 452. In this example, the recesses take the form of concave pockets 488. In plan view (FIG. 20) these are shown as having a circular perimeter, but other shapes may be used, including a not limited to circles, ellipses, squares, triangles, chevrons, or flower petal shapes.

The pockets 488 of this embodiment do not protrude beyond the outer surface 486 of the swirl vane 452.

The pockets 488 will help increase turbulence on both sides of the swirl vane 452 and thereby enhance fuel-air mixing. This degree of turbulence in mixing is greater than possible using holes along In the example of FIGS. 22-24, a swirler 550 has an annular array of swirl vanes 552, similar to the swirler 50 described above. Each swirl vane 552 includes at least one void passing through its thickness. In the illustrated example, the voids are arranged as groups of holes 584. The holes 584 may be arranged in a line, arc, or staggered pattern, and can be parallel to, or extend at different angles, relative to the outer surface 586 of the swirl vane 552.

Figure 24:
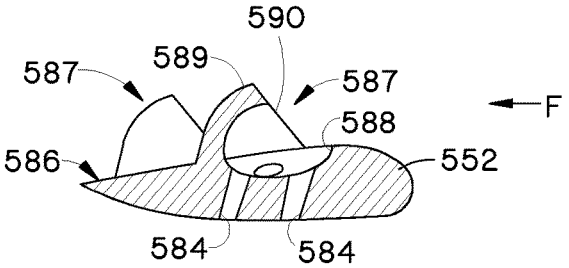
FIG. 24 is a sectional view taken along lines 24-24 of FIG. 23.

The holes 584 of each group communicate with a recess in the swirl vane 552. In this example, the recesses take the form of scoops 587. Each scoop 587 comprises a concave pocket 588 similar to the pocket 488 described above and a hood 589 which protrudes from the outer surface 586 of the swirl vane 552 and partially shrouds the corresponding pocket 588. The exposed opening 590 of each hood 589 generally faces upstream relative to a direction of local airflow "F" over the swirl vane 552. As best seen in FIG. 24, the opening 590 may be inclined, i.e. positioned at an acute angle relative to the outer surface 586 of the swirl vanes 552. The scoop 587 thus functions in the manner of an air inlet.

The inclined scoop will help to efficiently feed airflow to all of the holes 584 of the associated pocket 588 and will trip the boundary layer from the aft side of the scoop 587 on the vane outer surface 586. This will create high turbulence behind the scoop 587. The holes 584 communicating with the scoop 587 exit at various locations along the other side of the swirl vane 552 which will create an increase in turbulence improves fuel breakup and fuel/air mixing. This mixing can result in lowered oxides of nitrogen (NOx).

The swirler apparatus described herein has advantages over the prior art. Analysis has shown that the swirl vanes incorporating open area (perforations or gaps) will be effective to communicate pressure from one side of the vane to the other and provide a flow tangential velocity component. This will result in damping which mitigates undesirable combustion dynamics. The perforations or gaps in combination with recesses can improve fuel-air mixing.

The foregoing has described a swirler assembly for a combustor. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The disclosure is not restricted to the details of the foregoing embodiment(s). The disclosure extends to any novel one, or any novel combination, of the features disclosed in this specification (including any accompanying claims, abstract and drawings), or to any novel one, or any novel combination, of the steps of any method or process so disclosed.

Additional aspects of the present disclosure are provided by the following numbered clauses:

1. A dome assembly for a combustor, comprising: at least one swirler assembly including: at least one swirler including a plurality of swirl vanes arrayed about an axis, the swirl vanes oriented so as to impart a tangential velocity to air passing through the swirler parallel to the axis; each of the swirl vanes having a thickness and including a plurality of edges which collectively define a peripheral boundary of the respective swirl vane; wherein at least a selected one of the plurality of swirl vanes includes at least one void passing through the thickness of the selected swirl vane, the void disposed within the peripheral boundary of the selected swirl vane.

2. The dome assembly of any preceding clause wherein: the selected swirl vane has a porosity, defined as a total open area of the at least one void divided by a total surface area of the selected swirl vane lying within the peripheral boundary, of between approximately 5% and approximately 15%.

3. The dome assembly of any preceding clause wherein the porosity is approximately 10%.

4. The dome assembly of any preceding clause wherein at least one of the swirl vanes includes a plurality of perforations passing therethrough.

5. The dome assembly of any preceding clause wherein each of the swirl vanes includes a plurality of recesses communicating with an outer surface of the swirl vane, and each of the perforations communicates with one of the recesses 6. The dome assembly of any preceding clause wherein the recesses comprise open pockets.

7. The dome assembly of any preceding clause wherein the recesses comprise scoops, each scoop includes an open pocket and a hood which protrudes from the outer surface of the swirl vane, wherein each hood partially shrouds a respective one of the pockets.

8. The dome assembly of any preceding clause wherein each hood includes an opening which is inclined relative to the outer surface of the swirl vanes.

9. The dome assembly of any preceding clause wherein at least one of the swirl vanes includes a gap which separates it into two sub-vanes.

10. The dome assembly of any preceding clause wherein the swirler assembly includes a primary swirler axially adjacent to the secondary swirler.

11. The dome assembly of any preceding clause wherein the swirler assembly includes an outer swirler surrounding an inner swirler.

12. The dome assembly of any preceding clause further comprising a fuel nozzle configured to discharge fuel into air passing through the swirler assembly.

13. The dome assembly according to any preceding clause in combination with a combustor for a gas turbine engine, comprising an annular inner liner and an annular outer liner spaced apart from the inner liner.

14. A swirler assembly for a combustor, comprising at least one swirler including a plurality of swirl vanes arrayed about an axis, wherein each of the swirl vanes has a thickness and including a plurality of edges which collectively define a peripheral boundary of the respective swirl vane, and each of the swirl vanes includes at least one perforation passing through the thickness of the swirl vane, the at least one perforation disposed within the peripheral boundary of the swirl vane.

15. The swirler assembly of any preceding clause wherein:

the at least one swirl vane has a porosity, defined as a total open area of the at least one perforation divided by a total surface area of the at least one swirl vane lying within the peripheral boundary, of between approximately 5% and approximately 15%.

16. The swirler assembly of any preceding clause wherein the porosity is approximately 10%.

17. The swirler of any preceding clause wherein each swirl vane includes a plurality of perforations.

18. The swirler of any preceding clause wherein each swirl vane includes a single perforation configured as an elongated slot.

19. The swirler assembly of any preceding clause wherein each of the swirl vanes includes a recess communicating with an outer surface of the swirl vane, and the at least one perforation communicates with the recess.

20. The swirler assembly of any preceding clause wherein the recess comprises an open pocket.

21. The swirler assembly of any preceding clause wherein the recess comprises a scoop, the scoop including an open pocket and a hood which protrudes from the outer surface of the swirl vane, wherein the hood partially shrouds the pocket.

22. The swirler assembly of any preceding clause wherein the hood includes an opening which is inclined relative to the outer surface of the swirl vane.

23. A swirler assembly for a combustor, comprising at least one swirler including a plurality of swirl vanes arrayed about an axis, wherein the plurality of swirl vanes includes a first ring of sub-vanes and a second ring of sub-vanes, the first and second rings separated by gaps.

24. The swirler assembly of any preceding clause wherein: each sub-vane of the first ring is paired with a corresponding sub-vane of the second ring such that the two sub-vanes and the corresponding gap therebetween defines one of the plurality of swirl vanes; and each of the swirl vanes includes a plurality of edges surrounding the first and second sub-vanes of the pair, which collectively define a peripheral boundary of the respective swirl vane.

25. The swirler assembly of any preceding clause wherein: each of the plurality of swirl vanes has a porosity, defined as a total open area of the gap divided by a total surface area of the swirl vane lying within the peripheral boundary, of between approximately 5% and approximately 15%.

26. The swirler assembly of any preceding clause wherein the porosity is approximately 10%.

27. The swirler assembly of any preceding clause wherein the first ring of sub-vanes is angularly offset from the outer ring of sub-vanes.

28. The swirler assembly of any preceding clause wherein the first ring of sub-vanes includes a different number of sub-vanes than the second ring of sub-vanes.

29. The swirler assembly of any preceding clause wherein the sub-vanes of the first ring of sub-vanes are disposed at a different angular orientation than their corresponding sub-vanes of the second ring of sub-vanes.

What is claimed is:

1. A dome assembly for a combustor, comprising:

at least one swirler assembly including:

at least one swirler including a plurality of swirl vanes arrayed about an axis, the plurality of swirl vanes oriented so as to impart a tangential velocity to air passing through the swirler parallel to the axis;

each of the plurality of swirl vanes having a forward edge, an aft edge, a leading edge, and a trailing edge collectively defining a peripheral boundary of the swirl vane, and each of the plurality of swirl vanes having an outboard surface defined by the peripheral boundary and an inboard surface defined by the peripheral boundary, and each of the plurality of swirl vanes having a constant thickness between the outboard surface and the inboard surface and extending from the leading edge to the trailing edge;

wherein at least a selected one of the plurality of swirl vanes includes at least one void passing through the thickness of the selected swirl vane, the void extending through the thickness of the swirl vane through the outboard surface and through the inboard surface and disposed within the peripheral boundary of the selected swirl vane.

2. The dome assembly of claim 1 wherein:

the selected swirl vane has a porosity, defined as a total open area of the at least one void divided by a total surface area of the selected swirl vane lying within the peripheral boundary, of between approximately 5% and approximately 15%.

3. The dome assembly of claim 1 wherein at least one of the plurality of swirl vanes includes a plurality of perforations passing therethrough.

4. The dome assembly of claim 3 wherein each of the plurality of swirl vanes includes a plurality of recesses communicating with an outer surface of the swirl vane, and each of the perforations communicates with one of the recesses of the plurality of recesses.

5. The dome assembly of claim 4 wherein the plurality of recesses comprise open pockets.

6. The dome assembly of claim 4 wherein the plurality of recesses comprise scoops, each scoop includes an open pocket and a hood which protrudes from the outer surface of the swirl vane, wherein each hood partially shrouds a respective one of the pockets.

7. The dome assembly of claim 1 wherein at least one of the plurality of swirl vanes includes a gap which separates it into two sub-vanes.

8. The dome assembly according to claim 1 in combination with a combustor for a gas turbine engine, comprising an annular inner liner and an annular outer liner spaced apart from the inner liner.

9. A swirler assembly for a combustor, comprising at least one swirler including a plurality of swirl vanes arrayed about an axis, wherein each of the plurality of swirl vanes has a forward edge, an aft edge, a leading edge, and a trailing edge collectively defining a peripheral boundary of the swirl vane, and each of the plurality of swirl vanes having an outboard surface defined by the peripheral boundary and an inboard surface defined by the peripheral boundary, and each of the plurality of swirl vanes has a constant thickness between the outboard surface and the inboard surface and extending from the leading edge to the trailing edge, and each of the plurality of swirl vanes includes at least one perforation passing through the thickness of the swirl vane, the at least one perforation extending through the thickness of the swirl vane through the outboard surface and through the inboard surface and disposed within the peripheral boundary of the swirl vane.

10. The swirler of claim 9 wherein each swirl vane of the plurality of swirl vanes includes a plurality of perforations.

11. The swirler of claim 9 wherein each swirl vane of the plurality of swirl vanes includes a single perforation configured as an elongated slot.

12. The swirler assembly of claim 9 wherein each swirl vane of the plurality of swirl vanes includes a recess communicating with an outer surface of the swirl vane, and the at least one perforation communicates with the recess.

13. The swirler assembly of claim 12 wherein the recess comprises an open pocket.

14. The swirler assembly of claim 12 wherein the recess comprises a scoop, the scoop including an open pocket and a hood which protrudes from the outer surface of the swirl vane, wherein the hood partially shrouds the pocket.

* * * * *